United States Patent [19]

Linnemann

[11] Patent Number: 4,881,683

[45] Date of Patent: Nov. 21, 1989

[54] PAPERBOARD CONTAINER FOR SHIPPING MATERIAL IN BULK

[75] Inventor: Kent A. Linnemann, Cincinnati, Ohio

[73] Assignee: Shippers Paper Products Company, Loveland, Ohio

[21] Appl. No.: 148,928

[22] Filed: Jan. 27, 1988

[51] Int. Cl.[4] ..... B65D 5/36; B65D 3/28

[52] U.S. Cl. ..... 229/117.01; 108/51.3; 108/56.1; 206/600; 220/1.5; 220/400; 220/441; 220/446; 279/4.5; 279/23 R

[58] Field of Search ..... 220/1.5, 400, 402, 403, 220/404, 441, 446, 447, 465, 4 F, 466; 206/386, 600; 229/4.5, 41 R, 23 R, 41 B, 23 A, 41 C, 23 BT, 41 D; 108/51.3, 53.1, 56.1

[56] References Cited

U.S. PATENT DOCUMENTS

| | | | |
|---|---|---|---|
| D. 218,096 | 7/1970 | Craig . | |
| D. 222,252 | 10/1971 | Coleman et al. . | |
| D. 222,253 | 10/1971 | Coleman et al. . | |
| D. 222,254 | 10/1971 | Kattelmann et al. . | |
| D. 226,481 | 3/1973 | Coleman et al. . | |
| D. 268,249 | 3/1983 | Goedken . | |
| 2,872,079 | 2/1959 | Moore . | |
| 3,126,797 | 3/1964 | Carpenter et al. . | |
| 3,383,025 | 5/1968 | Ferrey et al. | 229/4.5 |
| 3,433,400 | 3/1969 | Hawkins . | |
| 3,460,718 | 8/1969 | Plant . | |
| 3,670,946 | 6/1972 | Croley | 229/4.5 |
| 3,712,530 | 1/1973 | Croley | 229/4.5 |
| 3,724,712 | 4/1973 | Starr et al. . | |
| 3,937,392 | 2/1976 | Swisher | 229/41 C |
| 4,019,635 | 4/1977 | Boots . | |
| 4,157,609 | 6/1979 | Schutz . | |
| 4,165,024 | 8/1979 | Oswalt et al. . | |
| 4,166,567 | 9/1979 | Beech, Jr. et al. | 229/41 D X |
| 4,173,288 | 11/1979 | Schutz . | |
| 4,516,692 | 5/1985 | Croley | 220/446 X |
| 4,729,505 | 3/1988 | Remaks et al. | 229/4.5 X |

*Primary Examiner*—Bryon P. Gehman

*Attorney, Agent, or Firm*—Wood, Herron & Evans

[57] ABSTRACT

A knockdown bulk container for storing and shipping bulk quantities of fluid and semi-fluid substances including an annular base, an annular cap and a circular side wall. The side wall is formed of a number of paperboard slats adhered to a sheet of paperboard. The side wall is adapted to be folded into a substantially flat condition for shipping and storing and formed into a cylinder which is inserted in the annular base for filling of the container. The dimensions of the base and cap are such that the cap and base are nestable. The bulk container provides substantial economies in space saving.

3 Claims, 5 Drawing Sheets

PAPERBOARD CONTAINER FOR SHIPPING MATERIAL IN BULK

BACKGROUND OF THE INVENTION

This invention relates to a container for shipping liquids and semi-fluid substances such as adhesives in bulk quantities add, more particularly, to a bulk container which may be easily assembled and disassembled for use and reuse.

In the shipping of quantities of fluids and semi-fluid materials such as adhesives used in industry today, it is common to ship these materials in containers of bulk quantity on the order of 55 gallons and larger whereby the user pumps out or otherwise removes desired quantities of material from the bulk container until empty afterwhich the container can be returned to the manufacturer for reuse. Typical bulk containers comprise both fiberboard drums having metal tops and bottoms and cardboard containers which are secured to wooden pallets. The drums and containers typically employ a plastic liner which is sealed to contain the material being shipped. At the point of use, the fluid then may be pumped out of the container or drained from the bottom.

Besides the problems of the size, weight and cost of current bulk containers is the problem that such containers exist in a manufactured or erected condition both before and after use. As a consequence, large amounts of space are involved in storing the containers for filling and after filling. In the shipment of containers from the manufacturer to the site where they are to be filled or used, large amounts of shipping space also is entailed. This is true with round containers where typically there is a large amount of void space between containers which is wasted space. After use, when the containers are returned to be refilled, considerable amounts of shipping space are again wasted by virtue of the geometries of the containers. There exists no container commercially available today which is capable of being easily assembled and easily disassembled before and between uses thereby greatly reducing the amount of the storage and shipping space needed for such containers.

SUMMARY OF THE INVENTION

It is among the principal objects of this invention to provide an improved bulk container which is capable of being assembled and disassembled as needed thereby greatly reducing storage and shipping space of the container.

It is a further object of this invention to provide a bulk container which is relatively inexpensive to produce but which is both relatively light-weight and strong thereby providing a secure, leakproof container which because of its relatively light weight can be shipped at a lower cost.

It is a still further object of this invention to provide such a knockdown bulk container wherein various elements thereof are nestable to greatly reduce the shipping and storing space.

DETAILED DESCRIPTION OF THE INVENTION

Figure 1:
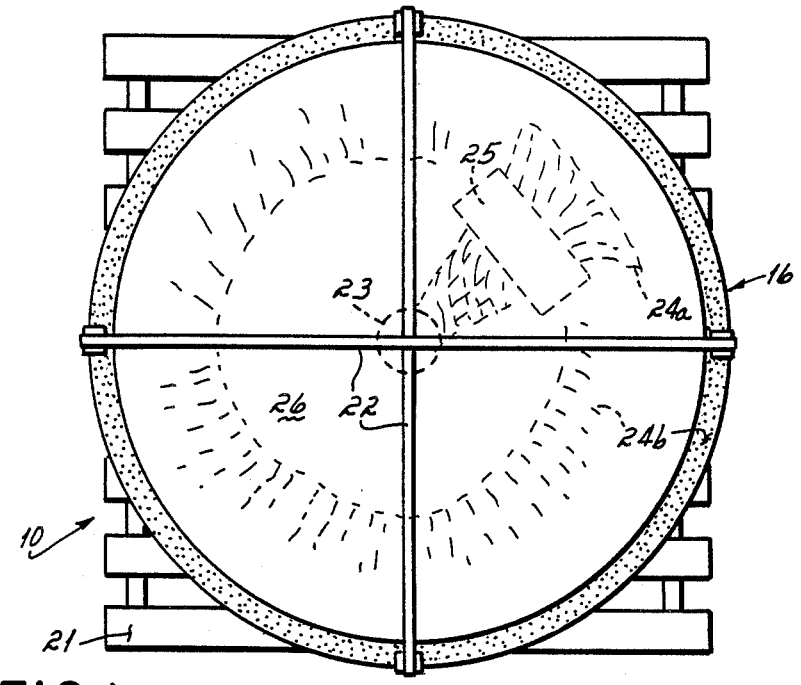
FIG. 1 is a top view of the bulk container of the present invention.
Figure 2:
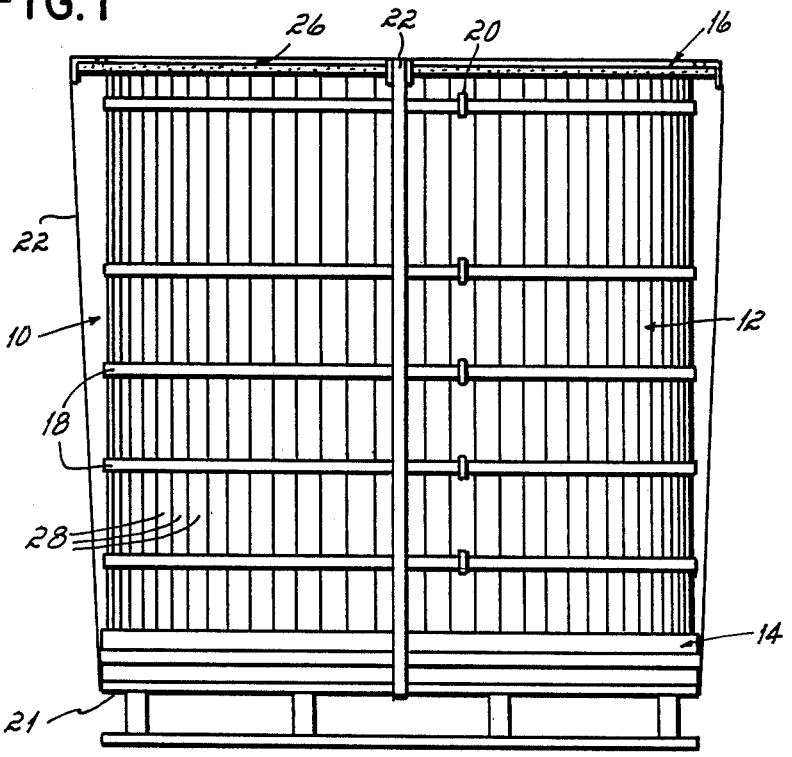
FIG. 2 is a elevation view of the bulk container of the present invention.

Referring now to FIGS. 1 and 2, the bulk container 10 of the present invention includes generally a cylindrical side wall 12 disposed between a circular base 14 and a circular top or cap 16. Metal or plastic bands 18 encircle the side wall 12 to give the container 10 additional strength to prevent outward bulging of the side wall 12 under the weight of the liquid contained therein. Clips 20 formed in the side wall 12 at locations spaced about the circumference thereof and spaced from top to bottom support the bands 18 in position spaced vertically along the height of the container. When filled, the bulk container 10 may be secured, if desired, to a wooden pallet 21 permitting its lifting for loading and unloading by a forklift truck. Like metal or plastic bands 22 extend across the top 16 of the container 10 and under the wooden pallet 21 and are tensioned by known strap tensioning tools to secure the bulk container 10 to the pallet 21. Interiorly of the container is a double walled plastic liner 24 (FIG. 3) formed, for example, of polyethylene. When the container is filled, the inner ply **24*a* of the liner 24 extends through an opening 23 in the cap 16 and is twisted and secured, e.g., by a piece of tape 25, to the cap 16, as indicated by dotted lines in FIG. 1. The outer ply 24*b* is then pulled up and over the cap 16, and both plies are covered by a circular cover 26**.

Figure 3:
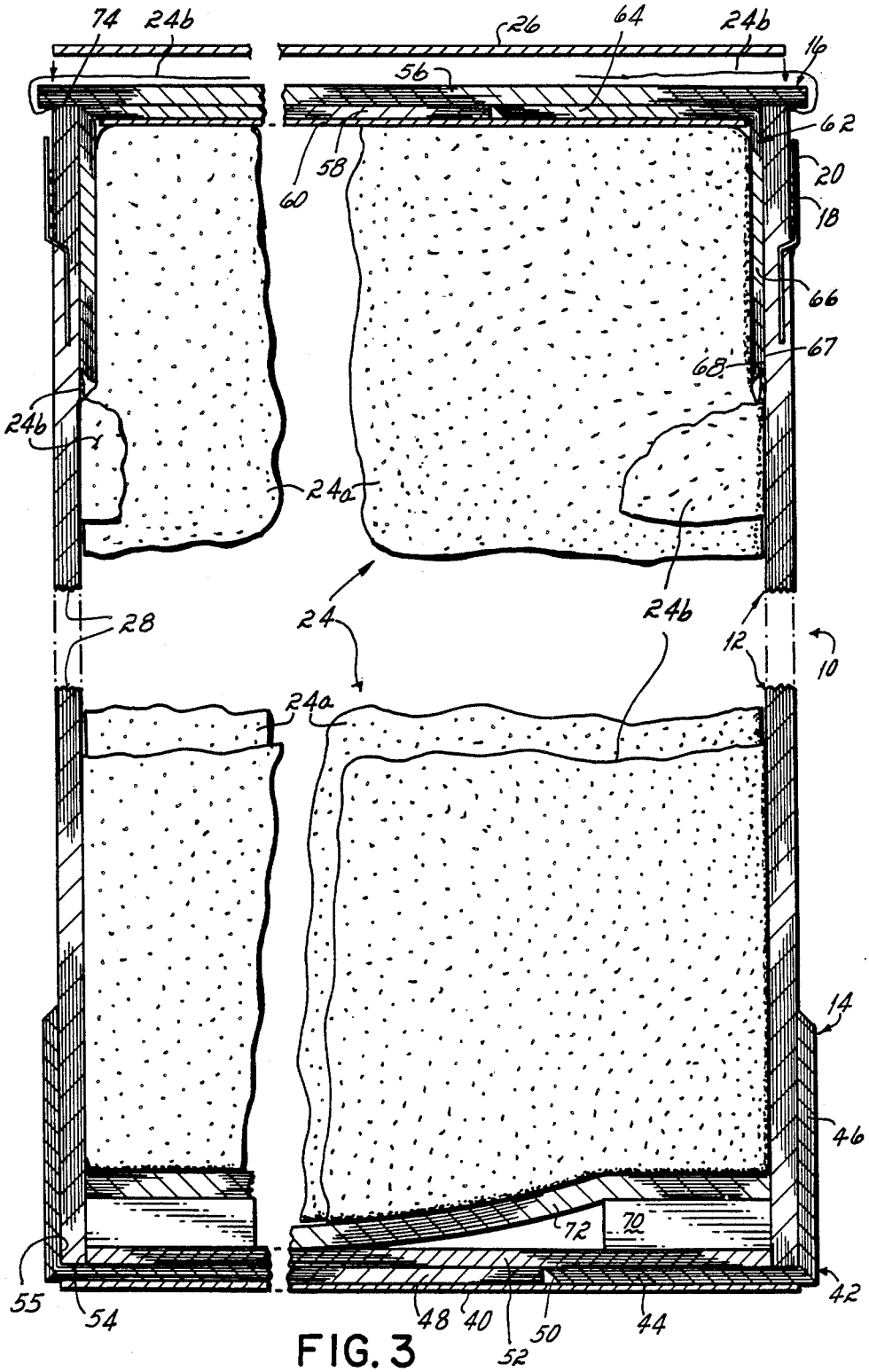
FIG. 3 is a cross-sectional view of the bulk container as shown in FIGS. 1 and 2.
Figure 4:
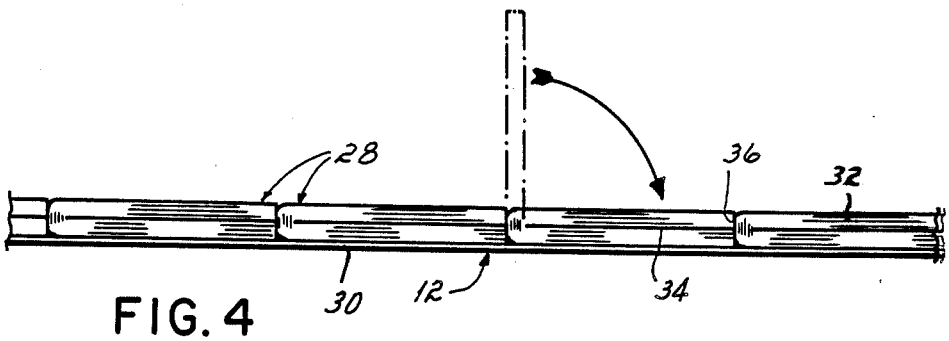
FIG. 4 is an end view of the construction of the side wall of the container.

Referring now to FIG. 3, there is shown a cross-sectional view of the bulk container 10 of the present invention. As stated, in its general configuration, the bulk container 10 includes a cylindrical side wall 12, a circular base 14, and a circular top or cap 16. Referring in addition to FIG. 4, the cylindrical side wall 12 is formed of a series of paperboard slats 28 (hereinafter described in detail) which are adhered in a vertical direction in substantially edge abutting relationship to the one surface of a single sheet of two-ply laminated paperboard 30.

Figure 4A:
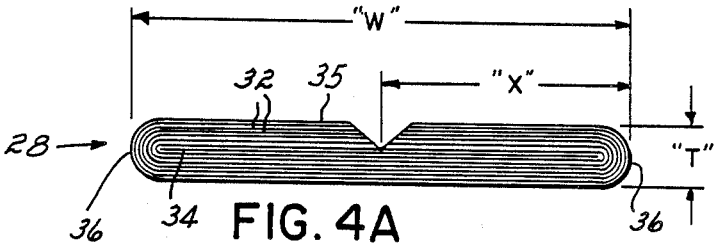
FIGS. 4A and 4B are diagrammatic illustrations of the slats forming a portion of the side wall of the bulk container shown in FIG. 4.
Figure 4B:
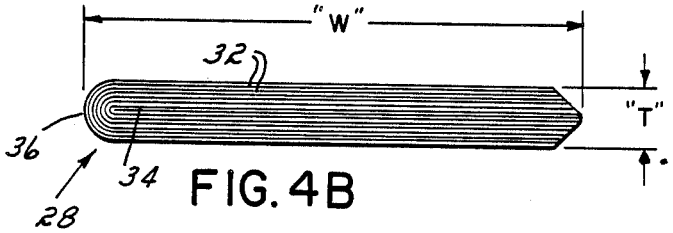

Referring now in addition to FIGS. 4A and 4B, the construction of the paperboard slats 28 of the present invention are shown in more detail. Each slat 28 is formed generally of an extended length by bringing together from multiple rolls sheets of paperboard and laminating them together with a suitable adhesive such as a sodium silicate slurry. The laminated sheets of paperboard are then folded along one or more fold lines 36 and the facing sheets fully pressed together such that the facing sheets are substantially coextensive one with another along an interface 34. A suitable adhesive is used to join the sheets together to form the final article. When the adhesive is set, the slats may then be cut to a desired length. As described below, the thickness of the resulting slats is a function of the number and thickness of the paperboard plies, and the width is a function of the width of the webs of paperboard used to form the slats. The facing sheets of the laminate on folding may be secured together by means of a similar adhesive, i.e., sodium silicate or a hot melt adhesive. In any event, the laminate must be formed and folded while the individual plies thereof are sufficiently slidable one with another to permit the folding. It has been found that such a construction provides a substantially warp-free paperboard member 28 which has a relatively high beam strength and resistance to deflection.

The paperboard slats 28 may be formed of various configurations. Two alternatives are illustrated by FIGS. 4A and 4B, respectively. In each embodiment, multiple plies 32 of paperboard are laminated and glued together. This laminated paperboard is then folded upon itself and glued thereto along the interface 34 to provide a slat having a width "W" and a thickness "T". As seen, the slat 28 has at least one rounded edge along the fold line 36 (FIG. 4B) or a pair of rounded edges along fold lines 36 (FIG. 4A). Although the slats 28 could be formed of a width "W" merely by laying up and laminating multiple plies of paperboard of width "W", it has been found that exceptional beam strength in the slat is provided by first laminating the multiple plies and then folding the element upon itself and gluing it to itself along line 34. This fold gives the slat more strength using the same amount of paper or the same strength with less paper than merely laminating multiple plies. Moreover the resulting product has been found to be surprisingly warp-free.

In FIG. 4A, the slat 28 is formed by folding two side edges of width "X"("X" equalling "X/2") and thickness "T/2" together and laminating them to the center section to provide a overall width "W" and thickness "T". In a presently preferred form of the invention, the dimension "W" is on the order of ½" to 4" and the thickness "T" from about 0.040" to 0.40 ".

It has been found that the embodiment shown in FIG. 4A has certain advantages over that shown in FIG. 4B in that the double fold tends to lessen warpage and give a more even product. Additionally, in the embodiment shown in FIG. 4A, a single sheet of paperboard 30 may be placed over the top surface 35 to provide uniformity or the outer paperboard ply of one of the folded portions can be extended over the other folded portion.

The paperboard slat may be formed in several alternative fashions. One is to bring together a number of plies of paperboard from individual rolls, glue them together, press the members together, form the resulting product first into a right angle and then press the legs of the angle together with an adhesive therebetween to form the folded structure as shown in FIGS. 3 and 4A and 4B. In this operation, the adhesive joining the sheets together has not been permitted to dry such that the sheets of laminated paper may still slip one with another to permit the folding of the plies. In an alternative method of manufacture, the laminated plies may be first formed into a right angle. Thereafter, while again the adhesive is sufficiently moist to permit slippage of the plies that right angle can then be pressed in a separate operation to form the slat construction. In this method of manufacture, a hot melt adhesive has been used to secure the facing sheets on their folding together across their respective surfaces, the hot melt providing a relatively short open period whereby adhering of the facing sheets can be accomplished before the legs of the angle have an opportunity to separate.

As stated, the warp-free paperboard slats 28 are adhered with a suitable adhesive to the outside surface of the paperboard sheet 30 forming the side wall 12 with the slats' 28 long direction running in the vertical direction of the bulk container 10. The slats 28 are in essentially edge abutting relationship to provide a structural side wall for the container. Selected spaced slats are provided with metal or plastic clips 20 placed therein at periodic intervals along their length which support the circumferential bands 18 for filling of the container. It has been found in addition to the relative high beam strength of the paperboard slats 28 that they provide good resistance to puncturing of the side wall when the container is filled with liquid.

Referring again to FIG. 4, the base 14 of the bulk container 10 is formed of a base sheet 40 to which is secured an annular paperboard rim 42. The annular rim 42 is formed of a paperboard angle of a thickness in the range of 0.225 to 0.250 inch. The horizontal leg 44 of the angle is cut (FIG. 5) to permit the angle to be bent into an annulus including an upstanding annular leg 46 about the base of the container comprised of the leg 46 of the angle opposite the horizontal leg 44. The cut horizontal legs 44 are glued to the base sheet 40 about its periphery. An intermediate circular sheet 48 is then glued to the base sheet 40 interiorly of the interior edge 50 of the horizontal legs 44 of the rim 42 to provide a substantially continuous horizontal plane across the member 14. A top circular member 52 having an outer diameter 54 less than the inner diameter 55 of the upstanding rim 42 by an amount equalling substantially the thickness of the side wall 12 is insertable and is supported on the intermediate circular member 48 and the horizontal legs 44 of the rim 42. The relative dimensions of the outer diameter 54 of the top circular member 52 and the inner diameter 55 of the rim 42 are such that the side wall 12 of the container is received therebetween and held in place thereby.

Figure 5:
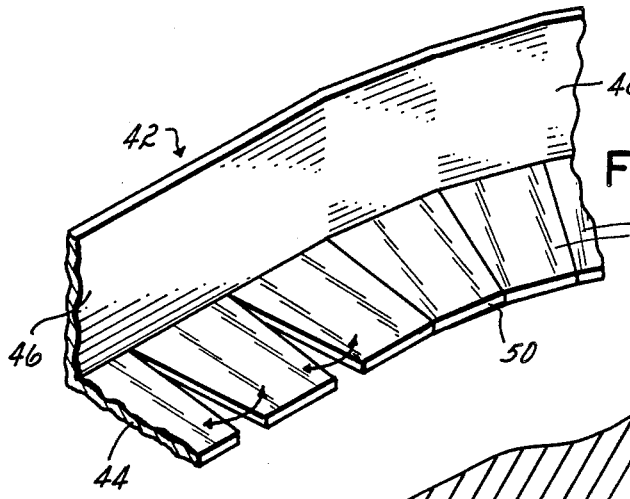
FIG. 5 is a pictorial view showing the forming of the top and base rims of the bulk container.

At the top of the container is a top or cap 16. The cap includes a top circular cap member 56, an intermediate circular cap member 58, a bottom circular cap member 60, and an annular rim 62. The top cap member 56 has a diameter greater than the diameter of the side wall 12; and, thus, when the cap 56 is inserted in place, it is supported by member 56 resting on the top of the side wall 12. The rim 62 is also formed of a paperboard angle of a thickness in the range 0.225 to 0.250 inch, which is likewise cut along one leg 64 to form segments permitting the angle to be bent into an annulus such as was shown in FIG. 5 with respect to the base 42. The cut portions of the leg 64 are adhered to the top cap member 56 with the opposing leg 66 of the angle providing a downwardly projecting annular leg 66 of the rim 62. The outer diameter 68 of the downwardly projecting rim 66 is substantially that of the inner diameter 67 of the side wall 12 such that when the cap 16 is inserted in position, the leg 66 slides inside the top of the container side wall 12. Except for dimensions, the rim 62 of the cap 16 is essentially the same construction as the rim 42 of the base 14 as shown in FIGS. 3 and 5.

The intermediate circular member 58 is an optional item. When employed, it is adhered to the top member 56 interiorly thereof to provide a substantially uniform horizontal plane extending to the leg 66. The bottom cap member 60 is then secured to sheet 58 and leg 64.

The bottom cap member 60, intermediate member 58, and top cap member 56 have a central hole 23 therethrough as shown in FIG. 1. To contain the liquid in the container 10, a double walled plastic liner 24 such as a polyethylene liner is inserted therein. Wedges 70 are placed about the base of the container to bias the flow of the liquid toward the center permitting substantially complete emptying of the container by means of drain hose (not shown) inserted through the hole 23 in the cap 16 to the bottom of the container 10. A cardboard sheet 72 is inserted between the liner 24 and the wedges 70 to provide a smooth transition supporting the base of the liner 24. The wedges 70 may be advantageously glued to either member 52 or member 72 or both to aid in assembly.

Figure 6:
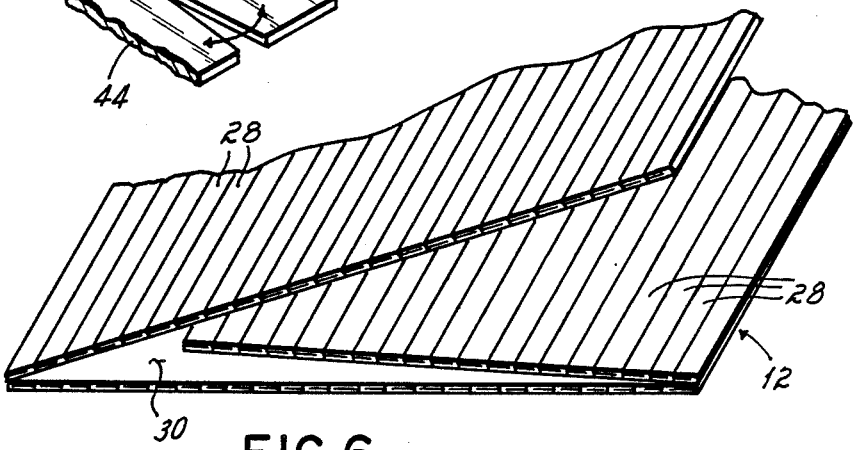
FIG. 6 is a pictorial view showing knockdown of the side walls.
Figure 7:
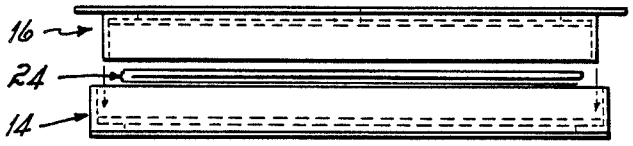
FIG. 7 is a pictorial view showing nesting of the top and bottom rims.
Figure 8:
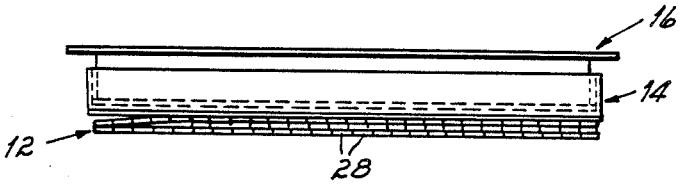
FIG. 8 is a pictorial view showing the bulk container of the present invention in the knockdown condition for storing and shipping.

As set forth above, one of the principal advantages of the bulk container of the present invention is its ability to be assembled and disassembled, as needed, thereby creating substantial savings in shipping and storing space. Referring now to FIGS. 6–8, it may be seen that the bulk container comprises essentially three structural units: the side wall 12, the base 14, and the cap 16. The side wall 12, which is formed of the paperboard slats 28 adhered to a paperboard sheet 30, is capable of being folded upon itself as shown in FIG. 6 to provide a substantially flat member in the knockdown condition. The dimensions of the cap 16 with respect to the base 14 are such that the rim 62 of the cap 16 is nestable inside the rim 42 of the base 14 whereby the cap and base may be shipped as a nested unit. The plastic liner 24 is advantageously folded and stored between the nested cap 16 and base 14. In addition, the bands 18 are folded and stored with the liner 24 in the nested cap 16 and base 14. As shown in FIG. 8, the knockdown side wall 12 and nested cap 16 and base 14 with liner 24 and bands 18 therein can thus be shipped in a compact unit.

To assemble the bulk container 10, the cap 16 is removed from its nested position in the base 14, and the liner 24 and bands 18 are also removed. The side wall 12 is placed on end and formed into a cylinder and inserted in the base 14 in abutting relation to the rim 42. The circular center sheet 52 is inserted interiorly of the cylindrical side wall 12 and tamped down to force the side wall 12 against the rim 42. The wedges may be inserted along with the cardboard sheet 72 thereabove. Alternatively at the point of manufacture, the wedges may be glued to the circular top sheet 52 and the cardboard member 72 glued to the wedges whereby the base is completed merely by inserting and tamping in place the composite structure.

The bands 18 are then placed in position about the side wall 12 and are supported in vertically spaced positions by the clips 20. The double-walled liner 24 is then unfolded and its top draped over the side wall 12 for filling. After filling with a liquid or other semi-fluid material, the inner sheet of the liner 24 is twisted closed while the outer sheet remains draped over the side wall 12. The cap 16 is then inserted in place with the downwardly projecting rim 62 sliding inside the side wall 12 until the top sheet 56 rests on the top edge 74 of the side wall 12. During this operation, the twisted portion of the inner ply of the liner is brought through the center hole 23 of the cap 16 and then secured, for example, by means of a strip of tape 25 to the top thereof. The outer liner is sandwiched between the rim 62 and the side wall 12. When the cap 16 is in place, the outer ply of liner 24 is brought up and over the edge of the top member 56. The dust cover 26 is placed on the cap 16 thereby covering the liner 24, and the entire structure is secured to the wooden pallet by tensioned bands 22. Edge protectors 76 placed between the bands 22 and cap 16 serve to protect the bands from cutting into the cap. Alternatively, the dust cover 26 may be provided with an annular rim to protect the edge thereof.

In use, the liquid in the container is pumped out through the top opening 23 by a tube which extends down to the center of the base. The wedges 70 at the base serve to drain the liquid to the center to permit substantially complete draining of the material in the container through the tube. Alternatively, a bottom drain could be applied through the side wall 12 to permit draining of the liquid by gravity.

Once the container is emptied, it may be knocked down for return for refilling merely by removing the top cap 16, removing the plastic liner 24, removing the bands 18, removing the side wall 12 from its position in the base 14, nesting the cap 16 in the base 14 with the liner 24 and bands 18 disposed therebetween, and folding the side wall 12 to a substantially flat condition for shipping as shown essentially in FIG. 8.

In some applications, it may be desired to secure the base 14 to the side wall 12 or the top 16 to the side wall 12 or both by means of tensioned bands. In the embodiment shown in FIGS. 1 and 2 and described above, the bulk container 10 is secured to a pallet 21 by straps 22 which serve in addition to secure the top 16 and base 14 in position with respect to the side walls 12 as well so that the members do not sperate, e.g., during shipping and handling.

Figure 9:
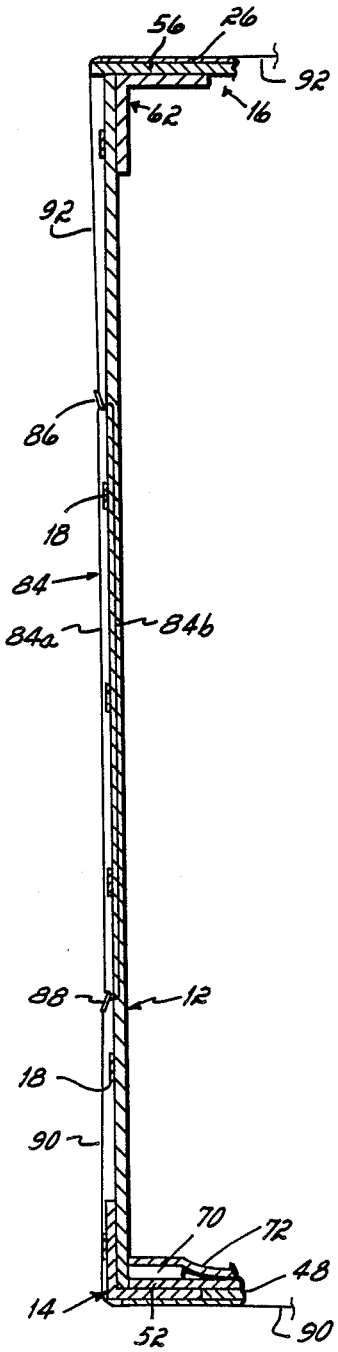
FIG. 9 is a cross-sectional view showing an alternative to one aspect of the bulk container of the present invention.
Figure 10:
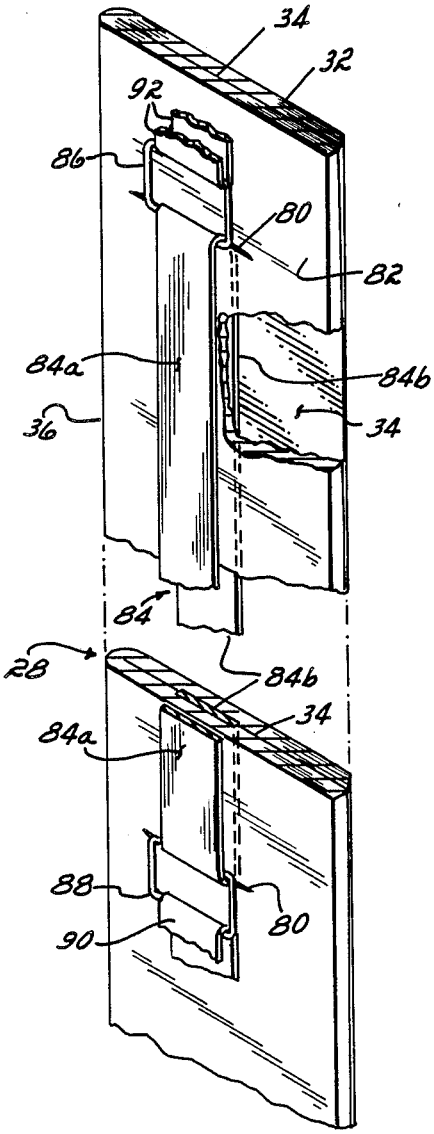
FIG. 10 is an isometric pictorial view with parts broken away of the alternative shown in FIG. 9.

Referring now to FIGS. 9 and 10, in an alternative application where a pallet may not be employed, it still may be desired to secure the base and cap to the side wall. In this embodiment, spaced slats 28, for example, four slats spaced at 90° intervals around the container are provided with slits 80 in one leg 82 thereof prior to the time the laminated paperboard 32 is closed and adhered to form the slat 28. A metal or plastic strap or band 84 is looped through the slits 80 in the paperboard and secured to itself by known strapping clips (not shown) to form a continuous loop having a portion thereof **84*a* passing on the outside of the slat 28. A pair of upper and lower buckles 86 and 88, respectively, are captured by the loop 84 prior to its securement. The slat 28 is then closed and adhered to itself along the interface 34, as in the previous embodiment, thereby laminating the inner portion 84*b* of the loop 84 within the slat 28**.

After the container 10 is erected, the base 14 may be secured with respect to the side wall 12 by passing a pair of bands 90 through and from the lower buckle 88 across the base sheet 40 of the base 14 and up to a buckle 88 located on the diametrically opposed slat. In this way, a pair of straps perpendicular to each other pass around and across the base 14 to secure the base 14 with respect to the side wall 12. After the container is filled and the cap 16 is in place, a similar pair of straps 92 may be passed through and from the upper buckles 86 of opposed slats to provide a pair of perpendicular bands passing around and across the top sheet 26 of the cap 16 to secure the cap to the container. When it is desired to knockdown the bulk container for shipment, the user need merely snip the upper 92 and lower 90 bands thereby releasing the cap and base. The band loop 84 passing through the slats, however, remains intact so that after the container is reassembled, it is only necessary to join new straps to the upper 86 and lower 88 buckles to secure the base and cap thereto. It will be appreciated, of course, that the upper 92 and lower 90 straps may be used as desired either jointly or singly depending upon the application.

Thus having described the invention, what is claimed is:

1. A bulk container comprising:

a base including an annular base rim and a circular center portion having a circumferential edge, said annular base rim being formed of multiple layers of paperboard laminated together and formed into a rigid right angle to provide a first upstanding leg forming an annulus about the base of the container, and a second leg at right angles thereto underlying said center portion, a cap including an annular top rim, said annular top rim being formed of multiple layers of paperboard laminated together and formed into a rigid right angle to provide a first downwardly projecting leg and a second leg at substantially right angles thereto, a generally cylindrical side wall having a top and a base and being comprised of a foldable paperboard sheet and a plurality of vertically aligned paperboard slats secured thereto in substantially edge abutting relation, each said slat comprising a plurality of layers of paperboard laminated together and folded upon itself and laminated to itself to provide a slat of predetermined width and length having at least one rounded edge and being substantially flat, said base of said side wall being insertable in between said first upstanding leg of said annular base rim and said circumferential edge of said center portion of said circular base and wedged therebetween, and said side wall being foldable to a substantially flat condition for shipping and storing and being assembleable in said circular base into an upright container.

2. A bulk container comprising:

a circular base including an annular base rim and a circular center disk having a circumferential edge, said annular base rim being formed of multiple layers of paperboard laminated together and formed into a rigid right angle to provide a first upstanding leg forming an annulus about the base of the container, and a second leg at right angles thereto underlying said center disk, a cap including an annular top rim, said annular top rim being formed of multiple layers of paperboard laminated together and formed into a rigid right angle to provide a first downwardly projecting leg and a second leg at substantially right angles thereto, a generally cylindrical side wall having a top and a base and being comprised of a foldable paperboard sheet and a plurality of vertically aligned paperboard slats secured thereto in substantially edge abutting relation, each said slat comprising a plurality of layers of paperboard laminated together and folded upon itself and laminated to itself to provide a slat of predetermined width and length having at least one rounded edge and being substantially flat, said base of said side wall being insertable inside said first upstanding leg of said annular base rim, said circular center disk being insertable within said base of said side wall with said circumferential edge of said center disk contacting said base of said side wall and wedging said base of said side wall between said circumferential edge and said first upstanding leg of said annular base rim, said side wall being foldable to a substantially flat condition for shipping and storing and being assembleable in said circular base into an upright container.

3. A bulk container comprising a circular base including an annular base rim and a center portion having a circumferential edge, said annular base rim being formed of multiple layers of paperboard laminated together and formed into a rigid right angle to provide a first upstanding leg forming an annulus about the base of the container, and a second leg at right angles thereto underlying said center portion, a cap including a circular top and an annular top rim, said annular top rim being formed of multiple layers of paperboard laminated together and formed into a rigid right angle to provide a first downwardly projecting leg and a second leg at substantially right angles thereto, said circular top being secured to said second leg of said annular top rim, a generally cylindrical side wall having a top and a base and being comprised of a foldable paperboard sheet and a plurality of vertically aligned paperboard slats secured thereto in substantially edge abutting relation, each said slat comprising a plurality of layers of paperboard laminated together and folded upon itself and laminated to itself to provide a slat of predetermined width and length having at least one rounded edge and being substantially flat, said base of said side wall being insertable in between said first upstanding leg said annular base rim and said circumferential edge of said center portion of said circular base and wedged therebetween, and said first downwardly projecting leg of said cap being insertable inside said cylindrical side wall at said top thereof, the relative diameters of said cap and said base being such that said first downwardly projecting leg of said cap is receivable within said first upstanding leg of said annular base rim, said side wall being foldable to a substantially flat condition for shipping and storing and being assembleable in said circular base into an upright container.

* * * * *